US009105166B1

(12) United States Patent
Kelsch et al.

(10) Patent No.: US 9,105,166 B1
(45) Date of Patent: Aug. 11, 2015

(54) ADJUSTABLE ANTI-THEFT BRACKET FOR DISPLAYING ELECTRONIC GADGETS

(71) Applicants: Vanguard Products Group, Inc., Oldsmar, FL (US); Christopher A. Kelsch, Tarpon Springs, FL (US)

(72) Inventors: Christopher A. Kelsch, Tarpon Springs, FL (US); John N. Figh, Jr., Oldsmar, FL (US); Lucas P. Swartwood, Tampa, FL (US); Bruno M. L. Telles, Tampa, FL (US); Weitong Zhu, Tampa, FL (US)

(73) Assignee: Vanguard Products Group, Inc., Oldsmar, FL (US)

( * ) Notice: Subject to any disclaimer, the term of this patent is extended or adjusted under 35 U.S.C. 154(b) by 0 days.

(21) Appl. No.: 14/226,331

(22) Filed: Mar. 26, 2014

Related U.S. Application Data

(60) Provisional application No. 61/806,659, filed on Mar. 29, 2013.

(51) Int. Cl.
*G08B 13/14* (2006.01)

(52) U.S. Cl.
CPC ..... *G08B 13/14* (2013.01)

(58) Field of Classification Search
CPC . G08B 13/14; G08B 13/1427; E05B 73/0082
USPC ..... 340/568.2, 568.6, 686.6, 692; 70/19, 70/58, 276, 431
See application file for complete search history.

(56) References Cited

U.S. PATENT DOCUMENTS 3,945,227 A 3/1976 Reiland
6,125,669 A 10/2000 McDaid et al.
7,028,513 B2 4/2006 Avganim
7,048,246 B2 5/2006 Leyden et al.
7,257,912 B2 8/2007 Yang
7,782,626 B2 8/2010 Buck et al.

(Continued)

FOREIGN PATENT DOCUMENTS

WO WO-2011-032147 A2 3/2011

OTHER PUBLICATIONS

Dandie, Bill. Samsung 10.1 Tablet Security and RTF's New Over Mold Strategy, Categor Archives: IPAD 2 Security. Feb. 14, 2013. billdandie.com/catagory/ipad-2-security.

(Continued)

*Primary Examiner* — Tai T Nguyen
(74) *Attorney, Agent, or Firm* — Andriy Lytvyn; Smith & Hopen, P.A.

(57) ABSTRACT

An anti-theft bracket for interactively displaying electronic gadgets. An electronic sensor is attached to the back of the gadget. An annular base surmounts the sensor. A circumferential channel is disposed on a lateral surface of the annular base. At least one arm is slidingly received within the circumferential channel, whereby the arm can move radially about the annular base. A clamp is in sliding communication with the arm forming an arm-clamp assembly. The overall length of the assembly is adjustable by sliding the clamp along the arm. A clamping member is attached to the clamp. A corner of the gadget is received within the space between the clamping member and the clamp, thereby securing the gadget within anti-theft device. The distance between the clamping member and the clamp may be adjustable to accommodate the thickness of the gadget.

17 Claims, 5 Drawing Sheets

(56) References Cited

U.S. PATENT DOCUMENTS

| | | | | |
|---|---|---|---|---|
| 8,061,164 | B2 | 11/2011 | Johnston et al. | |
| 2009/0223262 | A1* | 9/2009 | Zymroz | 70/174 |
| 2009/0235699 | A1* | 9/2009 | Hsiao et al. | 70/58 |
| 2011/0100073 | A1* | 5/2011 | Johnston et al. | 70/57.1 |
| 2011/0191864 | A1* | 8/2011 | Nagamura et al. | 726/35 |
| 2012/0241567 | A1 | 9/2012 | Gillespie-Brown et al. | |
| 2012/0273630 | A1 | 11/2012 | Gillespie-Brown et al. | |

OTHER PUBLICATIONS

International Search Report issued for international patent application No. PCT/US2010/048768 on Apr. 5, 2011.

* cited by examiner

ADJUSTABLE ANTI-THEFT BRACKET FOR DISPLAYING ELECTRONIC GADGETS

PRIORITY CLAIM

This patent application claims priority to U.S. Provisional Patent Application Ser. No. 61/806,659 filed Mar. 29, 2013 entitled "Adjustable Anti-Theft Bracket for Displaying Electronic Gadgets."

BACKGROUND OF THE INVENTION

1. Field of the Invention

This invention relates to merchandise anti-theft devices. More specifically, it relates to an adjustable bracket for securing an electronic gadget by clamping the opposite corners thereof.

2. Brief Description of the Related Art

Retailers often prefer to present their merchandise to consumers in a way that allows the consumers to touch, inspect, and otherwise interact with the products at a display counter. Many merchandise items, especially portable electronic devices, are relatively expensive and, therefore, are under a serious threat of theft. Retailers often face a dilemma of wishing to interactively displaying their merchandise to attract customers and increase sales, while, at the same time, safeguarding the merchandise against theft.

Several anti-theft devices are currently known in the art, but they have serious flaws. One example of an existing anti-theft device is disclosed in a published PCT application WO 2011/032147. The device includes a base that attaches to the back cover of the gadget via an adhesive layer. Two arms extend laterally from the base and grasp the opposite edges of the gadget, thereby securing it within the clamp. This anti-theft device, however, has a serious flaw: many electronic gadgets have removable back covers, which makes them vulnerable to theft because thieves can easily circumvent this anti-theft device by simply removing the back cover of the gadget and sliding the gadget out of the grasping arms. This flaw significantly undermines the efficacy of this device rendering it inadequate for many electronic gadgets.

Other currently available anti-theft solutions involve obtrusive and aesthetically unattractive devices such as steel cables, locks, and casings. Although these security measures may effectively protect against theft, they have a negative effect on the consumers by discouraging interaction with products and may ruin overall ambience of a retail store. Accordingly, there exists an unresolved need for a discrete and effective anti-theft device that adequately secures an electronic gadget while allowing the prospective purchasers to fully experience the gadget without obstructing access to any of the gadget's functional features, including the front screen.

SUMMARY OF THE INVENTION

The long-standing but heretofore unfulfilled need for a discrete and effective anti-theft device is now met by a new, useful, and nonobvious invention.

In one embodiment, an electronic sensor fixedly attaches to the back cover of an electronic gadget being displayed. An adhesive may be used to attach the top surface of the sensor to the merchandise item. An annular base surmounts the sensor. The annular base has at least a partial lateral surface. At least one circumferential channel is disposed on the lateral surface of the annular base.

The anti-theft bracket further includes at least two arms allowing for clamping the opposite corners of the gadget.

Some embodiments may involve more arms to provide additional security—the optimal number of arms depends on the geometry of the gadget. Each arm has a first end and a second end. The first end is adapted to be slidingly received within the circumferential channel on the lateral surface of the annular base. This configuration allows the arm to move radially about the base by sliding the first end within the channel.

The second end of the arm slidingly receives a clamp. The overall length of the arm-clamp assembly may be adjusted by sliding the clamp along the arm. The assembly includes a mechanism for retaining the clamp in place. In an embodiment, the retaining mechanism is a bolt received by a longitudinal threaded hole within the arm, whereby turning the bolt adjusts the length of the assembly. Other embodiments may involve a locking mechanism configured to immobilize the clamp with respect to the arm. In an embodiment, the locking mechanism is biased toward a locked position, and a magnet key is used to retract the locking mechanism into an unlocked position allowing the clamp to slide longitudinally along the arm.

Each clamp includes a clamping member. A corner of the gadget is received into the space between the clamp and the clamping member. The distance between the clamping member and the clamp is adjustable to conform to the thickness of the gadget. In an embodiment, the clamping member is attached to the clamp by two bolts, turning of which adjusts the distance between the clamping member and the clamp. In other embodiments, a locking mechanism similar to that described above can be used to immobilize the clamping member with respect to the clamp.

DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

In the following detailed description of the preferred embodiment, reference is made to the accompanying drawings, which form a part hereof, and within which specific embodiments are shown by way of illustration by which the invention may be practiced. It is to be understood that other embodiments may be utilized and structural changes may be made without departing from the scope of the invention.

Figure 1B:
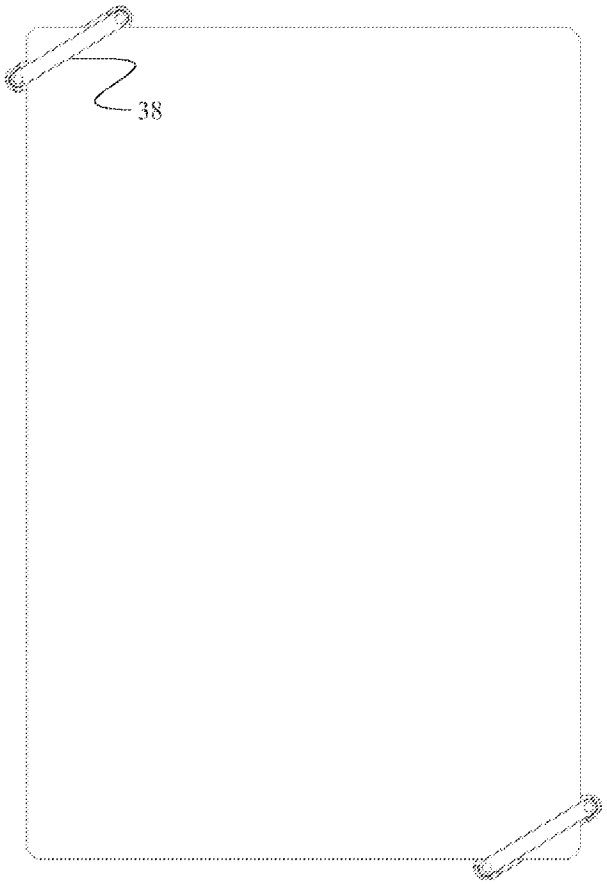
FIG. 1B is a front view of the electronic gadget secured by the adjustable anti-theft device.
Figure 1A:
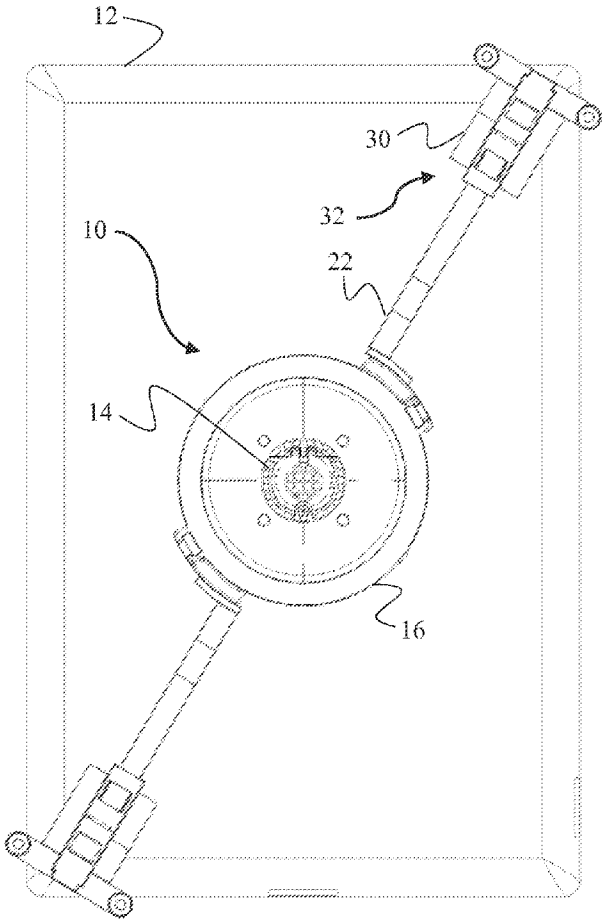
FIG. 1A is a back view of an electronic gadget secured by the anti-theft device.

Anti-theft device 10 securing an electronic gadget 12 is shown in FIGS. 1A and 1B. FIG. 1A depicts anti-theft device 10 attached to the rear of electronic gadget 12. Anti-theft device 10 secures gadget 12 by grasping two of its opposite corners without obstructing the front face of gadget 12, as shown in FIG. 1B, thereby providing perspective purchasers with a full access to the touch screen and all functional and esthetic features of gadget 12.

Figure 2:
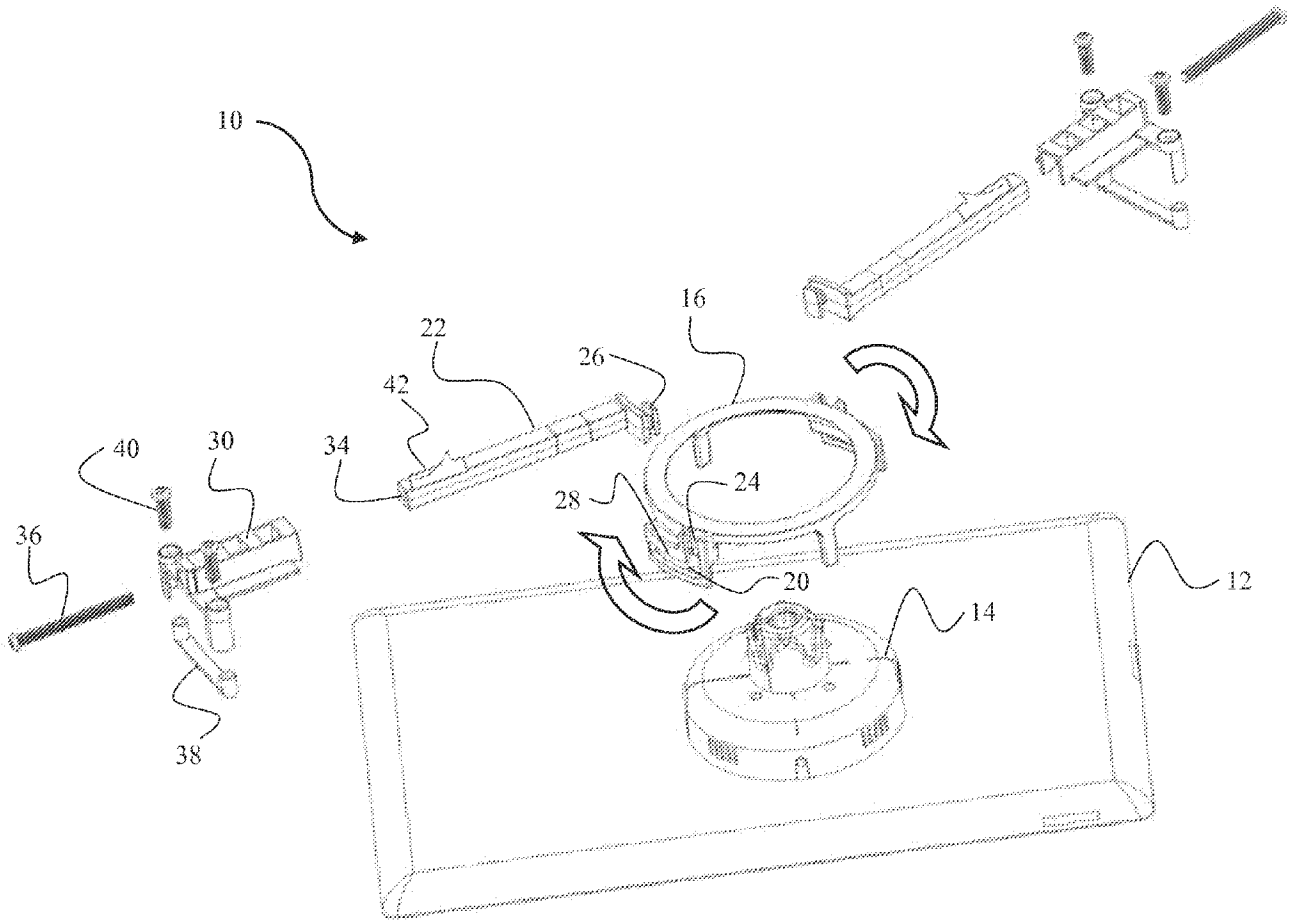
FIG. 2 is an exploded perspective view of the anti-theft device illustrative that arms are capable of radial movement about the base.

FIG. 2 shows an exploded view of anti-theft device 10. Anti-theft device 10 may include an electronic sensor 14 that is fixedly attached to the rear surface of an electronic gadget 12. Electronic sensor 14 provides an additional level of security by monitoring gadget 12 against unauthorized tempering or removal. Responsive to detection of unauthorized activity, such as an attempt to remove the back cover of gadget 12 or detach sensor 14, sensor 14 alerts the store personnel. The alert may be audio or visual, such as an alarm or flashing light. Sensor 14 may communicate with an alarm module that is configured to notify the appropriate parties of potential theft attempt. In the preferred embodiment, sensor 14 is attached to gadget 12 via an adhesive layer, although other means of attachment known in the art—such as screws, fasteners, fusion bonding, welding, hook-and-loop, etc.—also fall within the scope of the invention. It should be noted that anti-theft device 10 may also be used without sensor 14.

Continuing reference to FIG. 2, anti-theft device 10 includes an annular base 16 configured to surmount electronic sensor 14. The annular base includes at least a partial lateral surface, which contains a circumferential channel 20. In the embodiment depicted in FIGS. 2-5, the annular base contains two separate circumferential channels 20, where each channel 20 receives and slidingly retains one laterally extending arm 22. Arm 22 pivots about the center axis of base 16 when its first end slides within channel 20 as shown in FIG. 2.

Each arm 22 has a first end and a second end. The first end is adapted to be slidingly received within the circumferential channel 20. The circumferential channel 20 may contain ledges 28 adapted to slidingly retain the first end of arm 22 within channel 20. In the exemplary embodiment depicted in FIG. 2, channels 20 have an entry point 24 through which arm 22 is inserted. Once inside channel 20, tabs 26 of arm 22 engages the ledges 28 of channel 20. Arm 22 can only be removed from base 16 through entry point 24. Accordingly, when arm 22 is rotated into its operating position shown in FIG. 3, ledges 28 of channel 20 retain tabs 26 within channel 20. To remove arm 22 from base 16, arm 22 must be moved within channel 20 into a position where tabs 26 are aligned with entry point 24—at this point arm 22 can be removed from base 16. Other means of slidingly securing arm 22 within channel 20 are known in the art and fall within the scope of invention. For example, instead of having entry point 24, channel 20 may be configured to permit insertion of tabs 26 when they in a horizontal orientation. Once inside channel 20, arm 22 is rotated by 90 degrees about its longitudinal axis causing tabs 26 to engage ledges 28 of channel 20.

Anti-theft device 10 must have at least two arms 22. In the embodiment shown in FIG. 3, two arms 22 are used to secure opposite corners of gadget 12. Alternative embodiments may include additional arms 22, whereby each arm 22 corresponds to a corner or an edge of gadget 12. For example, anti-theft device 10 for securing a hexagonal gadget 12 may have six arms 22.

The second end of each arm 22 extends outwardly from annular base 16. The positioning of each arm 22 may be adjusted by sliding the first end of arm 22 within the circumferential channel 20—this results in arm 22 moving radially in the plane of the rear surface of gadget 12 about the center axis of base 16. Arms 22 may be interchangeable and may have different lengths, making anti-theft device 10 versatile enough to secure a variety of gadgets 12 ranging from small cellphones to large tablets.

The second end of each arm 22 receives a clamp 30. Clamp 30 is configured to secure a corner of gadget 12. Clamp 30 is in sliding communication with the second end of arm 22 forming clamp-arm assembly 32. Combined overall length of arm-clamp assembly 32 may be adjusted by sliding clamp 30 along arm 22. This feature allows anti-theft device 10 to adapt to the size of gadget 12. Each arm-clamp assembly 32 is independently adjustable, thus further increasing the versatility of anti-theft device 10.

Figure 3:
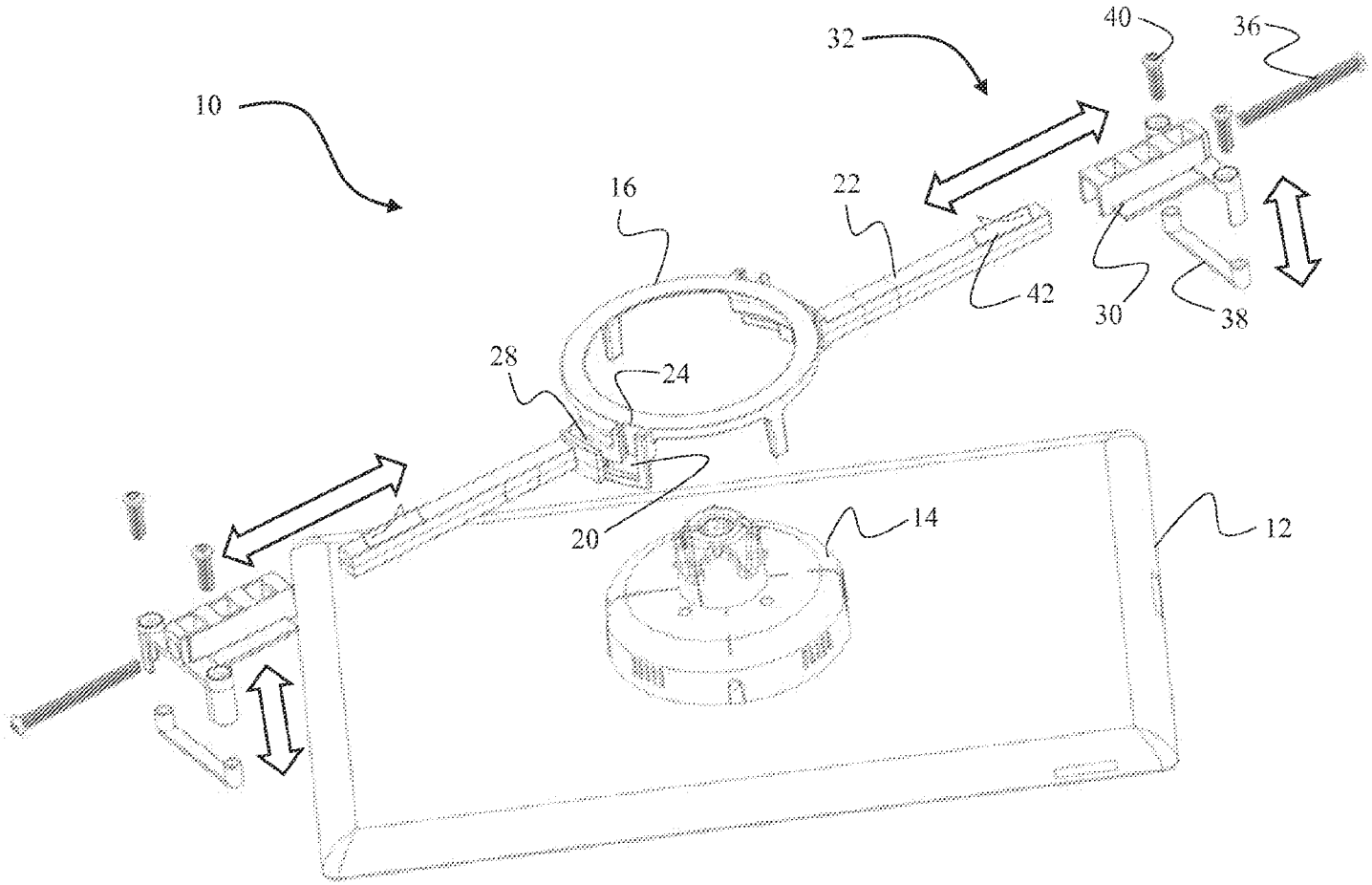
FIG. 3 is an exploded perspective view of the anti-theft device illustrating that length of arm-clamp assemblies are independently adjustable and that the clamps are also adjustable.

In the embodiment depicted in FIG. 3, each arm 22 contains a longitudinal threaded hole 34. Threaded hole 34 has an opening at the second end of arm 22, through which a bolt 36 is received. Bolt 36 connects clamp 30 to arm 22. Adjusting the length of arm-clamp assembly 32 requires turning the bolt in either clockwise or counterclockwise direction depending on whether the length of arm-clamp assembly 32 is being increased or decreased. In this embodiment, the length of arm-clamp assembly 32 cannot be adjusted without using a semi-specialized tool, such as a screwdriver with a correct head. Consequentially, an unauthorized party will not be able to slide clamp 30 along arm 22 without utilizing a tool, thereby making it difficult to remove gadget 12 from anti-theft device 10 without being detected by store personnel.

In an alternative embodiment, clamp 30 may be locked in a set position with respect to arm 22 after arm-clamp assembly 32 is adjusted to a proper length. Once clamp 30 is locked, it cannot slide along arm 22 as its movement is restricted by a locking mechanism 42. Locking mechanism 42 may be used to immobilize clamp 30 from sliding along arm 22. In this embodiment, bolt 36 may be eliminated as the length of arm-clamp assembly 32 is controlled by sliding clamp 30 along arm 22 until the desired position is reached—locking mechanism 42 will prevent clamp 30 from sliding away from that position.

A plurality of locking mechanisms 42 known in the art may be used to achieve this functionality including the following: a transverse screw, a pin, a tine disposed between arm 22 and clamp 30, a shuttle, a bayonet, a mechanical lock, a magnetic lock, and other similar means of preventing two members from sliding with respect to each other may be used. It is also within the scope of the invention, that locking mechanism 42 may involve a biased locking member, which may be unlocked by using a magnetic key to overcome the biasing force, thereby retracting the locking element into its unlocked position.

Figure 4:
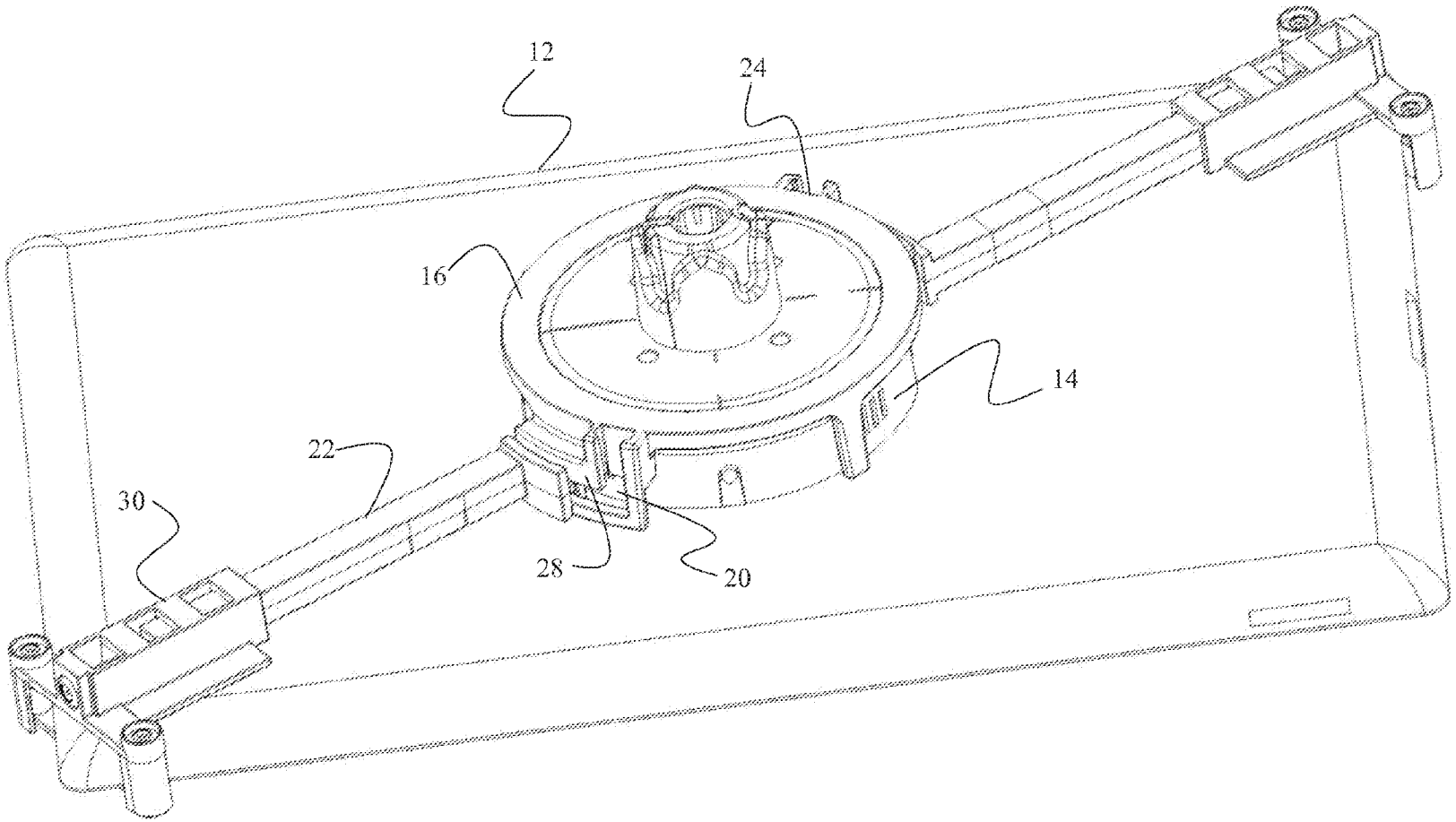
FIG. 4 is a perspective view of the anti-theft device securing an electronic gadget.

Referring to FIG. 3, clamp 30 includes an adjustable clamping member 38. The distance between clamping member 38 and clamp 30 may be adjusted to conform to the thickness of gadget 12 being secured. This further increases versatility of anti-theft device 10 by making it compatible with gadgets 12 of various thicknesses. An isometric view of gadget 12 secured by anti-theft device 10 is shown in FIG. 4.

As shown in FIG. 1, clamping member 38 is the only component of anti-theft device 10 visible to the customers interacting with gadget 12. Clamping members 38 are non-invasive and do not obstruct the screen of the device allowing the customers to fully experience gadget 12, while providing a high level of security.

Analogously to arm-clamp assembly 32, it is critical that unauthorized parties cannot adjust clamping member 38 without using a specialized tool. In the embodiment depicted in FIGS. 2 and 3, clamping member 38 is connected to clamp 30 by two bolts 40. Adjusting the distance between clamping member 38 and clamp 30 requires a screwdriver, making it difficult for a thief to avoid detection while trying to remove anti-theft device 10 from gadget 12. Alternative embodiments may involve different mechanisms for securing clamping member 38 to clamp 30. Some examples of such mechanisms may include transverse screws, biased tines or shuttles, mechanical locks, magnetically actuated locks, etc.

As evident from the above disclosure, one major advantage of anti-theft device 10 over the prior art is that anti-theft device 10 is highly adjustable to conform to a wide variety of gadgets 12 having different dimensions. Arms 22 may be available in different sizes depending on the type of gadget 12, and may be easily interchanged by simply removing one arm 22 from channel 20 and replacing it with another arm 22 of an appropriate size.

Figure 5:
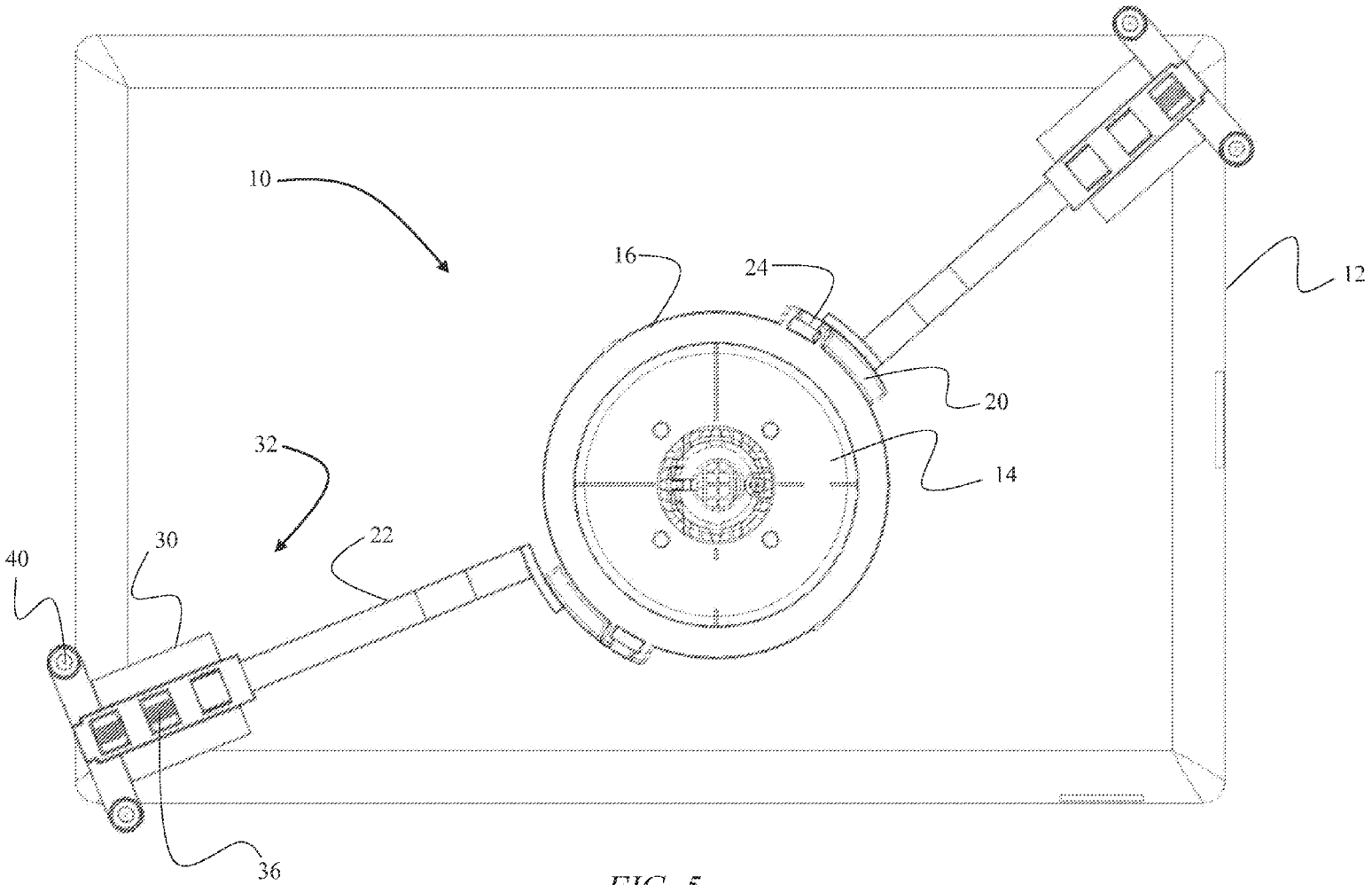
FIG. 5 is a perspective view depicting an electronic gadget being secured by the anti-theft device when an electronic sensor is positioned off-center.

Furthermore, arms 22 can move radially about the base allowing the anti-theft bracket to adjust to the geometry of gadget 12. The length of arm-clamp assembly 32 is also fully adjustable by sliding clamp 30 along arm 22, allowing the anti-theft bracket to conform to the dimensions of gadget 12. This feature provides an additional advantage of being able to effectively secure gadget 12 within anti-theft device 10 even when sensor 14 is attached off-center, as shown in FIG. 5, or when gadget 12 has an irregular shape. Finally, clamping member 38 is adjustable to accommodate the thickness of gadget 12. The high level of adjustability makes anti-theft device 10 very versatile, which is an enormous benefit considering the current high-paced technological environment where new devices with different shapes and dimensions are introduced almost on daily basis.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense. Although the above description refers to an electronic gadget, other types of electronic or non-electronic merchandise may be secured by the invention.

GLOSSARY OF TERMS

Arm—a component of the anti-theft device having two ends: one end is retained within the base, while the other end is in a sliding relationship with the clamp. The arms move radially about the base.

Arm-clamp assembly—a component formed collectively by an arm and a clamp in a sliding relationship with each other. The length of the arm-clamp assembly is adjustable by sliding the clamp along a longitudinal axis of the arm.

Base—a component of the anti-theft device to which arms slidingly attach. The base abuts the rear surface of a merchandise item and, in an embodiment, may be configured to surmount an electronic sensor. The base may have an annular shape.

Bolt—a rigid longitudinal member having a thread.

Channel—an elongated extrusion disposed on the base configured to receive and slidingly retain the first ends of the arms. The channel may be disposed either on the lateral surface or the top surface of the base. Ledges may be disposed on the outer perimeter of the channel to retain the first end of the arm within the channel.

Clamp—a component of the anti-theft device in a sliding relationship with the arm. The clamp is configured to grasp either a corner or an edge of the merchandise item. The clamp may include an adjustable clamping member to allow for adjustable clamp height to accommodate the thickness of the merchandise item.

Clamping member—a component of the clamp that may be adjusted with respect to the body of the clamp to achieve the desired height corresponding to the thickness of the merchandise item.

Electronic sensor—a sensor containing electrical components and circuitry configured to detect unauthorized tempering with or removal of the merchandise item to which the sensor is fixedly attached.

Locking mechanism—a component of the anti-theft device engaging two other components that are in a sliding relationship with each other to immobilize one of the components, thereby preventing that component from sliding in at least one direction. In an embodiment, the locking mechanism may be biased toward a locked position, and a key may be required to retract the locking mechanism into an unlocked position. In an alternative embodiment, the locking mechanism may be a pin, a bolt, a mechanical lock, or a magnetic lock.

Merchandise item—an item being secured by the anti-theft device. The merchandise items may have a variety of geometrical shapes. The merchandise item may be an electronic gadget, such as a tablet, a smartphone, a personal data assistant, etc.

What is claimed is:

1. An anti-theft device for securing a merchandise item comprising:

a base;

a channel disposed on the base;

a first arm having a first end and a second end, the first end being slidingly received within the channel, whereby the first arm moves radially about the base when the first end thereof slides within the channel;

a second arm having a first end and a second end, the first end being slidingly received within the channel, whereby the second arm moves radially about the base when the first end thereof slides within the channel;

a first clamp slidingly disposed on the second end of the first arm, the first clamp configured to receive a first corner of the merchandise item, the first arm and the first clamp collectively forming a first arm-clamp assembly; and a second clamp slidingly disposed on the second end of the second arm, the second clamp configured to receive a second corner of the merchandise item wherein the second corner is diagonally opposite from the first corner, the second arm and the second clamp collectively forming a second arm-clamp assembly;

wherein lengths and radial positions relative to the base of the first arm-clamp assembly and the second arm-clamp assembly are independently adjustable.

2. The anti-theft device according to claim 1, wherein a height of the clamp is adjustable to accommodate a thickness of the merchandise item.

3. The anti-theft device according to claim 1, wherein the first clamp comprises an adjustable clamping member.

4. The anti-theft device according to claim 3, wherein the first clamp further comprises a bolt connecting the clamping member to the clamp, whereby a height of the clamp changes responsive to the bolt being rotated about a center axis thereof.

5. The anti-theft device according to claim 3, further comprising a locking mechanism engaging the first clamp and the clamping member, whereby the locking mechanism restricts movement of the clamping member.

6. The anti-theft device according to claim 1, further comprising a bolt connecting the first clamp to the first arm, whereby the length of the first arm-clamp assembly changes responsive to the bolt being rotated about a center axis thereof.

7. The anti-theft device according to claim 1, further comprising a locking mechanism engaging the first clamp and the first arm, thereby restricting the first clamp from sliding along a longitudinal axis of the first arm.

8. The anti-theft device according to claim 1, further comprising an electronic sensor affixed to a rear surface of the merchandise item, the base surmounting the electronic sensor.

9. The anti-theft device according to claim 1, further comprising ledges disposed on an outer perimeter of the channel and complementary tabs disposed on the first end of the first arm, whereby the ledges engage the tabs to slidingly retain the first end of the first arm within the channel.

10. An anti-theft device, comprising:

an electronic sensor for attachment to a rear surface of a merchandise item;

a base surmounting the electronic sensor, the base having at least a partial lateral surface;

a circumferential channel disposed on the lateral surface of the base;

an arm having a first end and a second end, the first end slidingly retained within the circumferential channel, whereby the arm moves radially about the base responsive to the first end of the arm sliding within the circumferential channel; and a clamp in a sliding relationship with the second end of the arm, the clamp configured to receive a corner or an edge of the merchandise item, the clamp and the arm collectively forming an arm-clamp assembly, whereby a length of the arm-clamp assembly is adjustable by sliding the clamp longitudinally along the arm.

11. The anti-theft device according to claim 10, wherein a height of the clamp is adjustable to accommodate a thickness of the merchandise item.

12. The anti-theft device according to claim 10, wherein the clamp comprises an adjustable clamping member.

13. The anti-theft device according to claim 12, wherein the clamp further comprises a bolt connecting the clamping member to the clamp, whereby a height of the clamp changes responsive to the bolt being rotated about a center axis thereof.

14. The anti-theft device according to claim 12, further comprising a locking mechanism engaging the clamp and the clamping member, whereby the locking mechanism restricts movement of the clamping member.

15. The anti-theft device according to claim 10, further comprising a bolt connecting the clamp to the arm, whereby the length of the arm-clamp assembly changes responsive to the bolt being rotated about a center axis thereof.

16. The anti-theft device according to claim 10, further comprising a locking mechanism engaging the clamp and the arm, whereby the locking mechanism restricts the clamp from sliding along a longitudinal axis of the arm.

17. The anti-theft device according to claim 10, further comprising ledges disposed on an outer perimeter of the channel and complementary tabs disposed on the first end of the arm, whereby the ledges engage the tabs to slidingly retain the first end of the arm within the channel.

* * * * *